US011231161B1

(12) United States Patent
Jiang et al.

(10) Patent No.: US 11,231,161 B1
(45) Date of Patent: Jan. 25, 2022

(54) DIRECT-TYPE PANEL LAMP WITH UNIFORM LIGHT

(71) Applicant: CH LIGHTING TECHNOLOGY CO., LTD., Shaoxing (CN)

(72) Inventors: Jiangfeng Jiang, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 17/172,004

(22) Filed: Feb. 9, 2021

(30) Foreign Application Priority Data

Nov. 27, 2020 (CN) ..... 202022808105.3
Nov. 27, 2020 (CN) ..... 202022812456.1

(51) Int. Cl.

| | |
|---|---|
| ***F21V 7/00*** | (2006.01) |
| ***F21V 7/05*** | (2006.01) |
| ***F21V 3/00*** | (2015.01) |
| ***F21V 7/10*** | (2006.01) |
| *F21Y 113/10* | (2016.01) |
| *F21Y 105/10* | (2016.01) |
| *F21Y 115/10* | (2016.01) |

(52) U.S. Cl.
CPC ..... *F21V 7/05* (2013.01); *F21V 3/00* (2013.01); *F21V 7/10* (2013.01); *F21Y 2105/10* (2016.08); *F21Y 2113/10* (2016.08); *F21Y 2115/10* (2016.08)

(58) Field of Classification Search
CPC ..... F21V 7/05; F21V 7/10; F21V 7/16; F21V 7/18; F21V 3/00
See application file for complete search history.

(56) References Cited

U.S. PATENT DOCUMENTS

| | | | | |
|---|---|---|---|---|
| 6,193,392 | B1 * | 2/2001 | Lodhie | F21V 7/10 362/235 |
| 7,092,048 | B2 * | 8/2006 | Jeong | G02F 1/133308 349/58 |
| 2007/0121320 | A1 * | 5/2007 | Arai | G02F 1/133603 362/247 |
| 2007/0230206 | A1 * | 10/2007 | Hsiao | G02F 1/133605 362/560 |
| 2014/0098544 | A1 * | 4/2014 | Shin | F21V 5/04 362/308 |
| 2017/0160591 | A1 * | 6/2017 | Cho | G02B 5/0278 |
| 2018/0217449 | A1 * | 8/2018 | Mifune | G02F 1/133603 |

* cited by examiner

*Primary Examiner* — Gerald J Sufleta, II

(57) ABSTRACT

The present application discloses a direct-type panel lamp with uniform light, including a frame, a diffusion plate, a back plate, a reflective sheet and at least one lamp strip. A central region of the back plate bulges to form a chamber for accommodating the lamp strip. The chamber includes a flat bottom wall and inclined side walls. Each lamp strip is fixed on the bottom wall. The reflective sheet is located in the chamber and attached to the back plate. The reflective sheet is provided with cut-outs, and two side edges of each cut-out are attached to each other to adapt to a corner of the back plate. The cut-outs may prevent the folded edge from wrinkling or folding at the corners of the side walls, so that the reflective sheet is smoothly installed, avoiding causing light spots.

20 Claims, 9 Drawing Sheets

DIRECT-TYPE PANEL LAMP WITH UNIFORM LIGHT

TECHNICAL FIELD

The present application relates to the field of panel lamps, and particularly to a direct-type panel lamp with uniform light.

BACKGROUND

LED panel lamps have the advantages of good illuminance uniformity, soft and comfort light, environmental protection, small power consumption and the like, and is a kind of popular indoor lighting luminaire.

A basic structure of the panel lamp includes a frame, a back plate, a diffusion plate, a driving power supply and a plurality of light emitting assemblies. The back plate is mounted on the back of the frame, and the diffusion plate is mounted on the front of the frame. The back plate has a chamber, wherein the chamber includes a flat bottom wall and an inclined side wall. Each light emitting element is fixed on the bottom wall. The driving power supply is mounted on one backlight side of the panel lamp. The light emitting assemblies exhibit a uniform plane light emitting effect after passing through the diffusion plate with high light transmittance. The driving power supply is used to drive the light emitting elements.

The panel lamp further includes a reflective sheet, which is arranged between the light emitting assemblies and the back plate and configured to reflect light emitted from the light emitting elements. Since the reflective sheet needs to cover the inner wall of the chamber, problems such as wrinkling or folding may occur at corners, resulting in spots due to unevenness in local light intensities.

SUMMARY

In order to solve at least one of the above-mentioned problems, the present application provides a direct-type panel lamp with uniform light.

The present application provides a direct-type panel lamp with uniform light, including:

- at least one lamp strip, each lamp strip including a substrate and a plurality of LED beads fixed on the substrate;
- a back plate, with a central region bulging to form a chamber for accommodating the lamp strip, the chamber including a flat bottom wall and a plurality of inclined side walls, wherein each of the at least one lamp strip is fixed on the bottom wall;
- a diffusion plate, having a light transmitting function, and arranged opposite to the back plate to close the chamber;
- a frame, formed by connecting a plurality of frame strips, and each frame strip is connected with a respective edge of the diffusion plate and a respective edge of the back plate; and
- a reflective sheet, located in the chamber and attached to the back plate, wherein the reflective sheet is provided with a plurality of cut-outs, and two side edges of each cut-out are attached to each other to adapt to a corner of the back plate.

The following further provides a number of alternatives, and is merely intended as further additions or preferences rather than additional limitations on the above-mentioned overall solution. With respect to the above-mentioned overall solution, the alternatives may be combined separately without technical or logical contradictions, and may be combined together.

Optionally, the corners of the back plate are located at joining parts of the bottom wall and the side walls and/or at turning parts between the side walls.

Optionally, the reflective sheet includes a central region and a plurality of folded edges extending along side directions of the central region respectively, each cut-out is provided in a corner between two folded edges, the central region of the reflective sheet is attached to the bottom wall, the folded edges are attached to the side walls respectively, and two opposite side edges of each cut-out are attached to form a box-shaped structure.

Optionally, each substrate is located between the reflective sheet and the back plate, and the reflective sheet is provided with an avoiding hole for avoiding the LED beads.

Optionally, when the reflective sheet is in an unfolded flat state, an included angle between two opposite side edges of each cut-out ranges from 20 degrees to 90 degrees.

Optionally, the central region is of a polygon shape, the number of the folded edges is corresponding to a number of sides of the polygon shape, and joining parts of two adjacent folded edges along the circumferential direction of the central region are defined as the corners of the folded edges.

Optionally, the diffusion plate is of a flat plate structure and is arranged parallel to the bottom wall.

Optionally, the central region is configured as a rectangular shape, the number of the folded edges is four, and each folded edge is arranged on a respective side of the central region; and wherein each cut-out is arranged between two adjacent folded edges, and each folded edge extends with constant width along a side direction of the central region.

Optionally, the central region covers the bottom wall, each folded edge covers a corresponding side wall, and two adjacent folded edges are arranged without overlapping each other.

Optionally, a plurality of pores are provided at folds between the central region and the folded edges, and the plurality of pores are arranged in sequence along extending directions of the folds.

Optionally, each pore is strip-shaped, and the plurality of pores are arranged alongside directions of the central region.

Optionally, the pores are configured in the form of hollows or slits.

Optionally, the central region of the reflective sheet is provided with a plurality of repair holes;

wherein the at least one lamp strip includes a plurality of lamp strips, and adjacent lamp strips are electrically connected by at least one flexible strip, and connecting parts of the lamp strips and the flexible strip are respectively corresponding to the repair holes.

Optionally, the plurality of lamp strips extend longitudinally and are spaced apart from each other, the LED beads on the lamp strips are aligned, the at least one flexible strip is arranged and extending horizontally; and the repair holes are aligned with each other.

Optionally, as for each repair hole, along a length direction of the corresponding lamp strip, a distance between two opposite edges of the repair hole is greater than the width of the corresponding flexible strip; and along a length direction of the corresponding flexible strip, a distance between two opposite edges of the repair hole is greater than the width of the corresponding lamp strip.

Optionally, in a same lamp strip, the LED beads include a plurality of first LED beads and a plurality of second LED beads, wherein the first LED beads and the second LED beads are alternately arranged, and the first LED beads and the second LED beads are different in brightness or color temperature.

Optionally, in a same lamp strip, one of the first LED beads and one of the second LED beads which are adjacent form a set of beads, and a distance between the first LED bead and the second LED bead in a same set of beads is L1, a distance between two adjacent sets of beads is L2, and the following condition is met: L1:L2=1:2 to 8.

Optionally, the repair holes are provided adjacent to one side of the reflective sheet, and at most one set of beads is arranged between each repair hole and the side of the reflective sheet to which the repair hole is adjacent.

Optionally, all the first LED beads are electrically connected by a first circuit, and all the second LED beads are electrically connected by a second circuit;

wherein the at least one flexible strip includes two flexible strips, and the two flexible strips are respectively electrically connected with the first circuit and the second circuit; and two repair holes corresponding to a same lamp strip are arranged spaced apart or continuously.

Optionally, each flexible strip is located between two adjacent sets of beads, and at most one set of beads is arranged between the two flexible strips.

In the direct-type panel lamp of the present application, the cut-outs of the reflective sheet may prevent the folded edges from wrinkling or folding at the corners of the side walls, so that the reflective sheet is smoothly mounted, thereby avoiding causing light spots.

Figure 1:
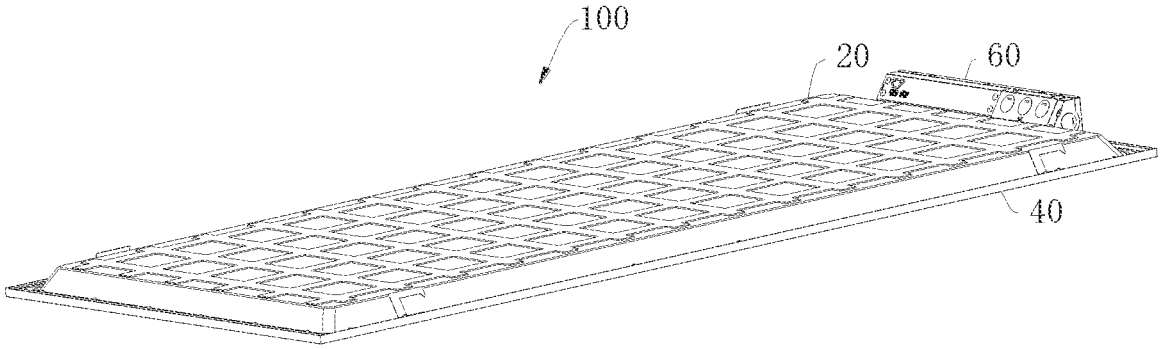
FIG. 1 is a schematic view showing a structure of a direct-type panel lamp according to an embodiment provided by the present application.

Reference numerals in accompanying drawings are illustrated as follows:

100. direct-type panel lamp; 101. driving module;

10. lamp strip; 11. substrate; 111. metal layer; 112. insulating layer; 113. circuit layer; 114. second opening; 115. pad; 12. LED bead; 13. lens; 131. protruding leg; 14. flexible strip; 141. first opening; 142. insulating layer; 143. circuit layer; 144. solder resist layer; 15. first LED bead; 16. second LED bead;

20. back plate; 211. protrusion; 22. edge region; 221. central region; 23. chamber; 231. bottom wall; 232. side wall; 24. protruding rib; 25. slope region;

30. diffusion plate;

40. frame; 41. frame strip; 42. first mounting surface; 43. second mounting surface; 44. horizontal portion; 45. vertical portion; 46. thickening portion; 47. vertical flange; 471. screw groove;

50. reflective sheet; 51. central region; 52. folded edge; 53. cut-out; 54. avoiding hole; 55. repair hole.

60. driving box; 61. box body; 611. wire through chamber; 612. wire through hole; 62. top cover; 63. cover plate; 631. unit hole; 632. unit cover; 633. shielding portion; 634. fixing portion; 64. first side; 641. second side; 642. third side; 643. fourth side; 644. fifth side; 65. lug; and 66. insulating box.

DESCRIPTION OF THE EMBODIMENTS

The following will clearly and completely describe technical solutions in embodiments of the present application in conjunction with accompanying drawings in the embodiments of the present application. Obviously, embodiments described are only a part of embodiments of the present application, and are not all of embodiments thereof. Based on the embodiments in the present application, all other embodiments obtained by those ordinarily skilled in the art without paying any creative efforts fall within the protection scope of the present application.

It should be noted that when an assembly is referred to be "connected" with another assembly, it may be directly connected with the other assembly or there may be an intervening assembly. When an assembly is considered to be "disposed" on another assembly, it may be directly disposed on another assembly or there may be an intervening assembly.

Unless otherwise defined, all technical and scientific terms used herein have the same meaning as commonly understood by those skilled in the technical field to which the present application belongs. The terms used in the specification of the present application herein are only for the purpose of describing specific embodiments, and are not intended to limit the present application. The term "and/or" as used herein includes any and all combinations of one or more of the related listed items.

A direct-type panel lamp generally includes a lamp housing. At least one side of the lamp housing is a light transmissive side. A light emitting element is mounted within the lamp housing and configured to transmit light to the light transmissive side. The so-called direct-type generally refers to that the light transmissive side is located on a bottom surface of the lamp housing in a use state, and the light emitting element directly transmits light to the light transmissive side, that is, transmits light downwards, for illumination. When the light emitting element is in the form of a LED, a corresponding driving module may be is equipped according to the light emitting requirement of the light emitting element. The driving module may be equipped separately, that is, there is no definite spatial relationship between the driving module and the lamp housing, and the driving module is connected with the lamp housing during use. Certainly, the driving module may be in the form of an integrated manner, that is, may be fixedly mounted relative to the lamp housing. In order to improve the lighting effect, a reflective sheet may be attached within the lamp housing. The common reflective sheet may be made of materials such as PET, PP, and PVC. The reflective sheet is capable of reflecting light emitted from the lamp strip towards a light emitting side. However, the reflective sheet may be wrinkled or folded on the corners, affecting the light uniformity. As shown in FIGS. 1 to 7, an embodiment of the present application provides a direct-type panel lamp 100, which includes a frame 40, a back plate 20, a diffusion plate 30, a reflective sheet 50 and at least one lamp strip 10.

A central region 221 of the back plate 20 bulges to form a chamber 23 for accommodating the lamp strips 10, the chamber 20 includes a flat bottom wall 231 and inclined side walls 232, and each lamp strip 10 is fixed on the bottom wall 231.

The diffusion plate 30 is disposed opposite to the back plate 20 to close the chamber 23. The frame 40 is formed by connecting a number of (generally, four) frame strips 41, and each frame strip 41 is connected with respective edges of the diffusion plate 30 and the back plate 20.

The lamp strip 10 includes a substrate 11, LED beads 12 fixed on the substrate 11, and lenses 13 covering the LED beads 12.

The reflective sheet 50 is located within the chamber 23 and attached to the back plate 20. The reflective sheet 50 is provided with cut-outs 53. Two side edges of each cut-out 53 are attached to each other to adapt to a of the back plate 20.

The reflective sheet 50 includes a central region 51 and folded edges 52 extending along side edges of the central region 51. Cut-outs 53 are provided at corners of the folded edges 52. The central region 51 of the reflective sheet 50 is attached to the bottom wall 231. The folded edges 52 are attached to the side walls 232. Two opposite side edges of each cut-out 53 are attached so as to form a box-shaped structure.

The flat bottom wall 231 of the back plate 20 is interpreted to have a flat surface or a curved surface with flat-curve, which at least makes sure that no obvious wrinkles exist after the reflective sheet having been attached. The inclined side wall 232 is interpreted as that there is a noticeable bent between the side wall 232 and the bottom wall 231, but no strict limitation is applied to an inclination angle.

As for the structure, the back plate 20 needs to be bent itself to form a three-dimensional structure to enclose the chamber 23. The corner of the back plate 20 is located at a joining part of the bottom wall 231 and the side wall 232 and/or at a corner of the side wall 232. The bending of the side wall 232 makes it difficult for all parts of the side wall 232 to be coplanar. The cut-out 53 is provided to preventing the folded edge 52 from wrinkling or folding at the corner of the side wall 232. The central region 51 of the reflective sheet 50 and the folded edges 52 may be fixed to the back plate 20 by means of adhesive.

The diffusion plate 30 has a light transmitting function on the light transmissive side (for example, using a light transmissive material). Light emitted by the LED beads 12 pass through the lenses 13 and the diffusion plate 30 in sequence. After the light is diffused, the multiple LED point light sources form a uniform surface light source.

In one embodiment, the central region 51 of the reflective sheet 50 is of a polygon shape, and the number of the folded edges 52 corresponds to the number of sides of the polygon shape. The joining part of two adjacent folded edges is located at a corner of the folded edges 52 along the circumferential direction of the central region 51.

In a preferred embodiment, the diffusion plate 30 is of a flat structure and is parallel to the bottom wall 231. The lamp housing formed by connecting the back plate 20 and the diffusion plate 30 is generally in a shape of a frustum of a pyramid.

For example, by taking a quadrilateral as an example, the central region 51 is formed in a rectangular shape, the number of the folded edges 52 is four, and the folded edges 52 are respectively arranged on the corresponding sides of the central region 51. A cut-out 53 is provided between two adjacent folded edges 52, and each folded edge 52 extends with constant width in a side direction of the central region 51. When the reflective sheet 50 is unfolded in a flat state, a center line of each cut-out 53 coincides with a diagonal line of the central region 51.

With reference to one of the embodiments, the central region 51 covers the bottom wall 231, each folded edge 52 covers the corresponding side walls 232, with two adjacent folded edges 52 not overlapping each other. The width of the folded edge 52 is the same as or slightly smaller than that of the side wall 232, so that the folded edge 52 can cover the corresponding side wall 232 as much area as possible, and can prevent the folded edge 52 from wrinkling and causing unevenness of the reflective sheet 50.

Figure 2:
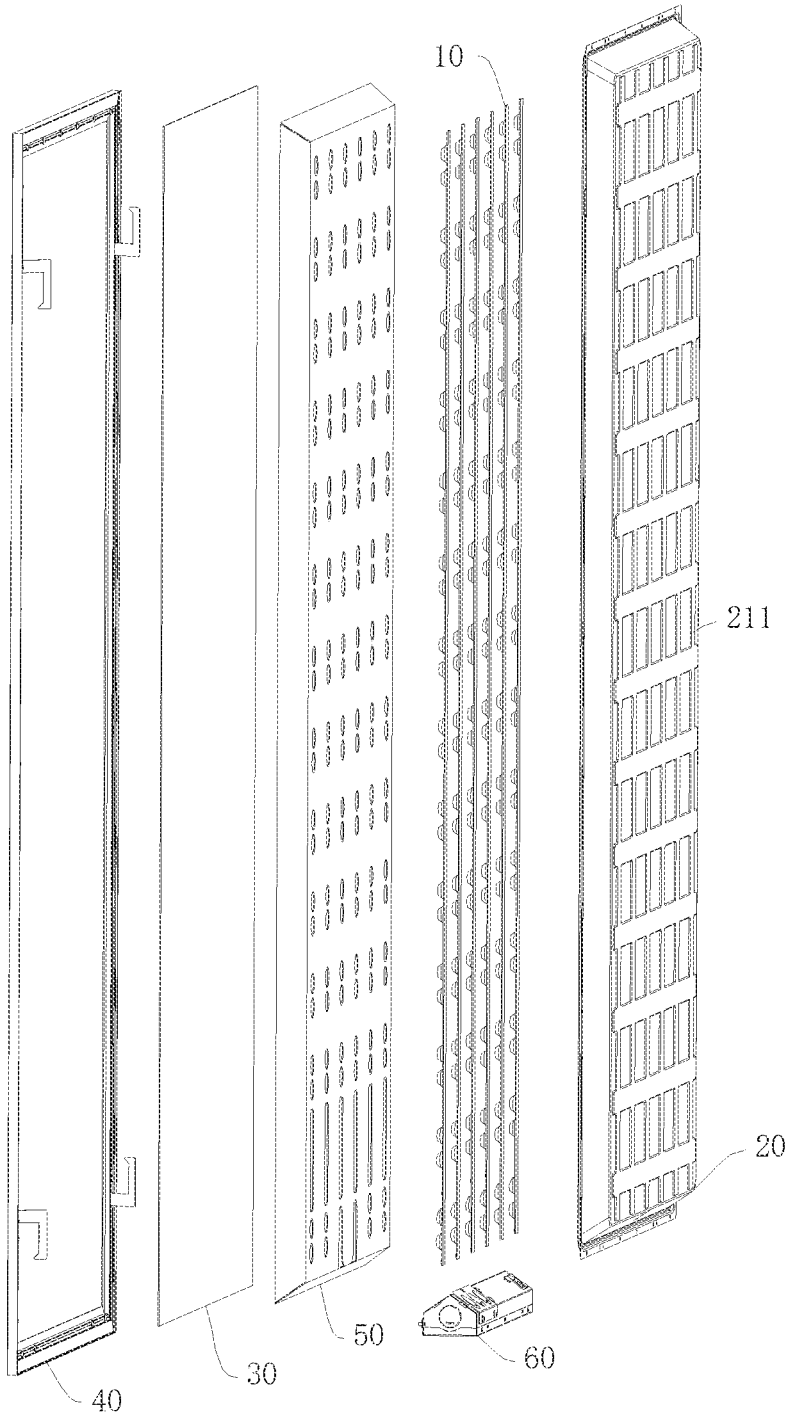
FIG. 2 is a schematic exploded view showing a structure of a direct-type panel lamp in FIG. 1.
Figure 5:
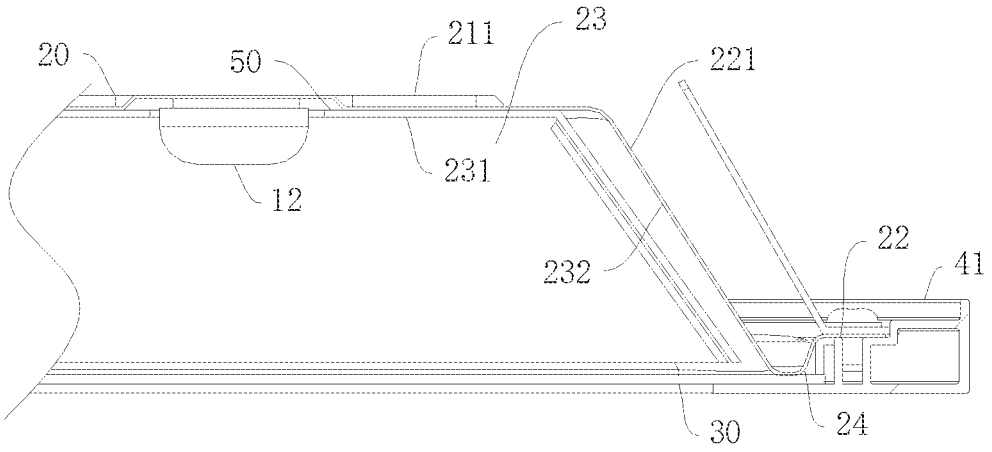
FIG. 5 is a schematic view showing a structure in which a frame strip is omitted in FIG. 1.

With reference to one of the embodiments, as shown in FIG. 2 and FIG. 5, for a mounting position of the reflective sheet 50, the substrates 11 are located between the reflective sheet 50 and the back plate 20, and the reflective sheet 50 is provided with avoiding holes 54 for allowing the LED beads 12 and the lenses 13 to be exposed. The reflective sheet 50 is able to cover the substrates 11 of the lamp strip 10 to prevent from producing a shadow on the substrates 11 which affects the emission of light from the direct-type panel lamp 100. Certainly, in some further embodiments, the substrates 11 may be additionally processed, for example, a white reflective material may be coated on the substrate 11, but it will increase a process flow of the lamp strip 10.

A contour of each avoiding hole 54 is corresponding to that of a respective lens 13, so that the reflective sheet 50 covers the bottom wall 231 as much as possible. In this embodiment, each lens 13 is of a spherical crown shape, and the corresponding avoiding hole 54 is circular. The diameter of the avoiding hole 54 ranges from 15 mm to 35 mm. Preferably, the diameter of the avoiding hole 54 is 20 mm.

If the included angle between two opposite side edges of the cut-out 53 is too large or too small, it will affect a relationship between two opposite side edges of the cut-out 53 when the reflective sheet 50 is in a mounted state (for example, two opposite side edges of the cut-out 53 overlap each other or a gap between two opposite side edges of the cut-out 53 is too large). With reference to one of the embodiments, in order to solve the above-mentioned problem, when the reflective sheet 50 is in an unfolded flat state, an included angle between two opposite side edges of the cut-out 53 ranges from 20 degrees to 90 degrees. Meanwhile, the included angle between the side wall 232 and the bottom wall 231 affects an included angle between two opposite side edges of the cut-out 53 of the side wall 232. Preferably, the included angle between two opposite side edges of the cut-out 53 is 30 degrees.

With reference to one of the embodiments, in order to facilitate the folding of the folded edge 52 relative to the central region 51, a plurality of pores are provided at the fold between the central region 51 and the folded edge 52, which are sequentially provided along an extending direction of the fold. Each pore is strip-shaped, and the pores are arranged along a side direction of the central region 51.

For the specific form of the pores, in one embodiment, the pores are configured in the form of hollows or slits. When the folded edge 52 is bent relative to the central region 51, two sides of the pore can be attached or abutted one another, so as to avoid affecting the reflection of light emitted from the lamp strip 10.

The reflective sheet 50 can reflect the light emitted from the lamp strip 10. The reflective sheet 50 may cover connecting wires of the lamp strip 10. When the connecting wires of the lamp strip 10 fail, there is a need for removing the reflective sheet 50 before the connecting wires can be inspected and repaired, causing inspection and trouble.

Figure 3:
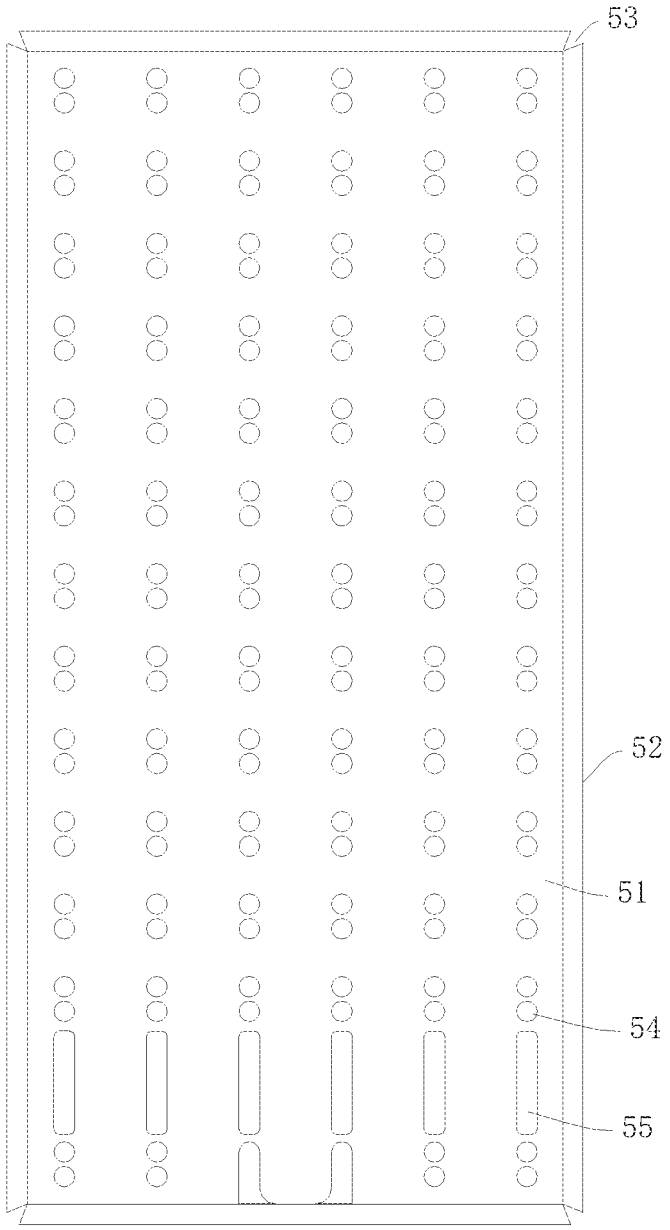
FIG. 3 is a schematic view showing a structure of a reflective sheet in a flat state in FIG. 2.
Figure 7:
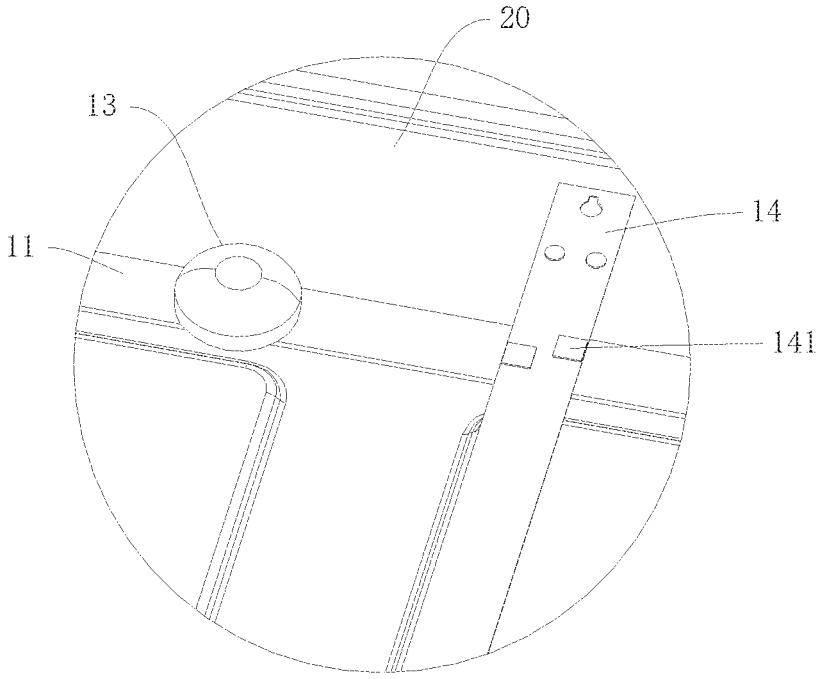
FIG. 7 is a schematic view showing a structure of a connection between lamp strips.
Figure 8:
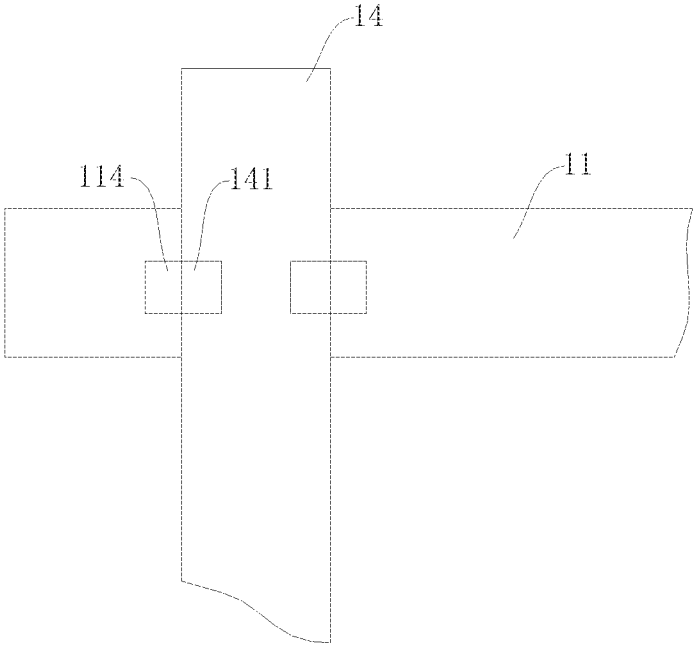
FIG. 8 is a schematic view showing a structure of a connection between a substrate and a flexible strip in FIG. 7.
Figure 9:
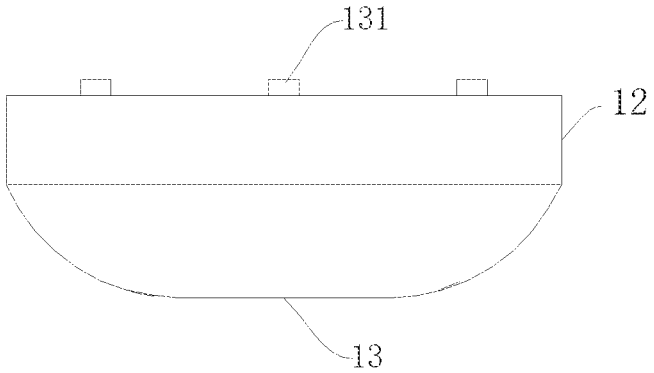
FIG. 9 is a schematic view showing a structure of a LED bead and a lens in FIG. 7.
Figure 10:
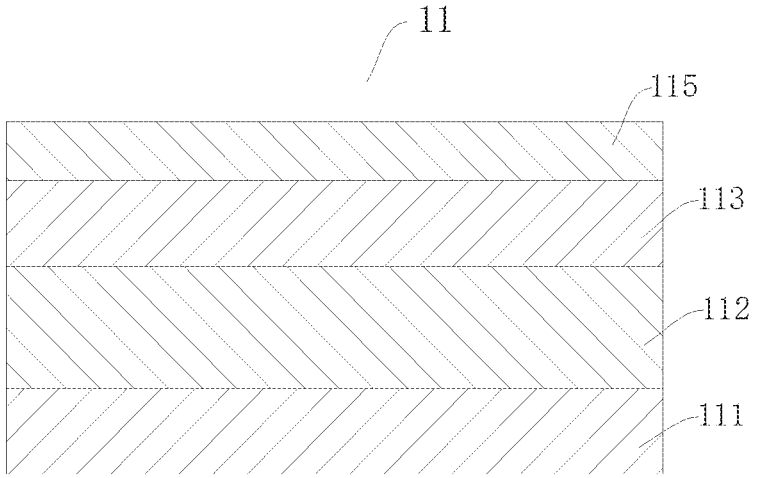
FIG. 10 is a schematic view showing a structure of a circuit board in FIG. 7.
Figure 11:
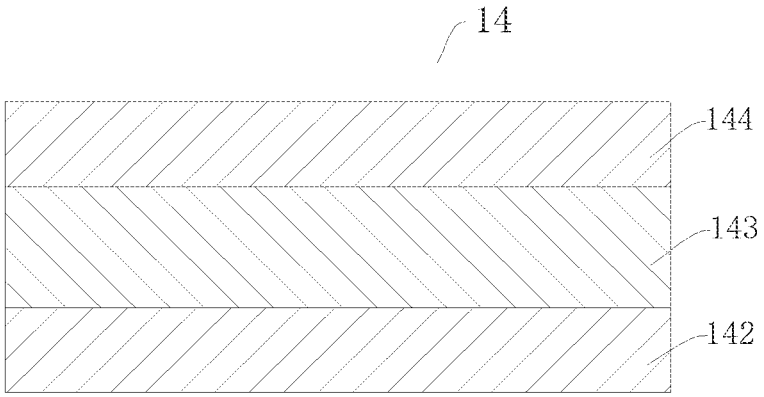
FIG. 11 is a schematic view showing a structure of a flexible strip in FIG. 7.

In some embodiments, as shown in FIG. 2, FIG. 3 and FIG. 7, in order to solve this technical problem, the lamp strips 10 are electrically connected by a flexible strip 14 (the flexible strip is a conductive body, has a certain flexibility so as to bring the convenience for coiling and storage, and is cut according to a required length when being used, avoiding the waste of leftovers). The central region 51 of the reflective sheet 50 is provided with a plurality of repair holes 55. Connecting parts of the lamp strips 10 and the flexible strip 14 are respectively corresponding to the repair holes 55. The connecting parts of the flexible strip 14 and the lamp strips 10 can be repaired through the repair holes 55.

In one of the embodiments, in order to form a certain operating space when the connecting parts of the flexible strip 14 and the lamp strips 10 are repaired, as for each repair hole, along a length direction of the corresponding flexible strip 14, a distance between two opposite edges of the repair hole 55 is greater than the width of the corresponding lamp strip 10. Along a length direction of the corresponding lamp strip 10, a distance between two opposite edges of the repair hole 55 is greater than the width of the corresponding flexible strip 14.

Figure 4:
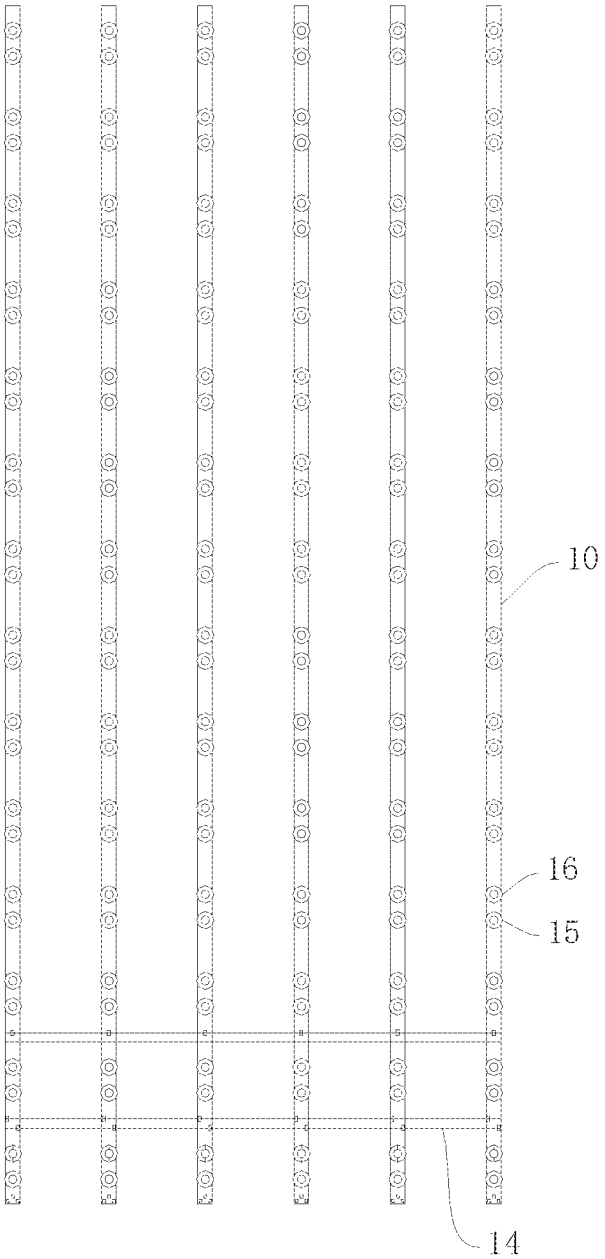
FIG. 4 is a schematic view showing a structure of a lamp strip in FIG. 2.

In some embodiments, as shown in FIG. 2 and FIG. 4, the lamp strips 10 each extend longitudinally and are spaced apart from each other. The LED beads 12 on respective lamp strips 10 are aligned. The flexible strips 14 extend horizontally, so that the repair holes 55 are aligned. The LED beads 12 are distributed in a matrix on the inner side of the back plate 20, so that the light sources are evenly distributed, and moreover, the convenience is brought for mounting each lamp strip 10. The so-called horizontal direction and longitudinal direction are only relative terms, for example, they are approximately perpendicular.

With reference to one of the embodiments, in order to change the emission of light from the direct-type panel lamp 100, within a same lamp strip 10, the LED beads 12 include a plurality of first LED beads 15 and a plurality of second LED beads 16, wherein the first LED beads 15 and the second LED beads 16 are alternately arranged, and the first LED beads 15 and the second LED beads 16 are different in brightness or color.

The first LED beads 15 and the second LED beads 16 are arranged alternately one followed by another or alternately in groups, such as the following examples.

When the first LED beads 15 and the second LED beads 16 are arranged alternately one followed by another, that is, one first LED bead followed by one second LED bead, and they by one first LED bead, and then one second LED bead and along the length direction of the lamp strip 10 repeatedly arranged in this manner.

When the first LED beads 15 and the second LED beads 16 are arranged alternately in groups, a group of first LED beads followed by a group of second LED beads, and then by a group of first LED beads, and then by a group of second LED beads along the length direction of the lamp strip 10 and repeatedly arranged in this manner. Moreover, the numbers of the LED beads in the groups may be the same or different, and the number of LED beads in at least one group is greater than 1. By taking two LED beads in each group as an example, when the first LED beads 15 and the second LED beads 16 are arranged alternately in groups, that is, two first LED beads are followed by two second LED beads, and then by two first LED beads, and then by two second LED beads along the length direction of the lamp strip 10, and repeatedly arranged in the manner.

In a preferred embodiment, the numbers of the LED beads in the groups are the same when the first LED beads 15 and the second LED beads 16 are arranged alternately in groups, and the number ranges from 2 to 5.

For the difference in brightness or color temperature, for example the first LED bead 15 is brighter and the second LED bead 16 is darker. For another example, the first LED bead 15 emits white light, and the second LED bead 16 emits yellow light.

Alternatively arranging the first LED beads 15 and the second LED beads 16 enables the LED beads 12 be relatively compactly arranged on the lamp strip 10, so that reducing a relatively large space inside the direct-type panel lamp 100 which is occupied by the lamp strip 10.

For a positional relationship between the first LED beads 15 and the second LED beads 16 on the same lamp strip 10, with reference to one of the embodiments, in the same lamp strip 10, the first LED bead 15 and the second LED bead 16 which are adjacent to each other form a set of beads. A distance between the first L) bead 15 and the second LED bead 16 in the same set of beads is L1, a distance between two adjacent sets of beads is L2, and the following condition is met: L1:L2=1:2 to 8. Preferably, L1:L2=1:6.

Specifically, L1 ranges from 5 mm to 10 mm, and L2 ranges from 20 mm to 40 mm. In this embodiment, L1 is 5 mm, and L2 is 30 mm.

The flexible strip 14 is located between two adjacent sets of beads, and at most one set of beads is arranged between two flexible strips 14. The repair holes 55 are arranged adjacent to a side of the reflective sheet 50, and at most one set of beads is arranged between the repair hole 55 and the side of the reflective sheet 50.

With reference to one of the embodiments, in order to control the first LED beads 15 and the second LED beads 16 independently, all the first LED beads 15 are connected to a first circuit and receive driving signals thereby. All the second LED beads 16 are connected to a second circuit, and receive driving signals thereby.

The driving signal may come from a control module integrated in the direct-type panel lamp itself. For example, in one embodiment, the direct-type panel lamp has a driving module, and the driving module sends driving signals to the first circuit and the second circuit independently.

The driving signal may come from a separately configured external driving module. Each LED bead may be turned on or off by means of the driving signal, so as to present a desired lighting effect. A conventional technology may be used for implementing the driving signal in terms of the form of the driving signal itself.

The first circuit and the second circuit in this embodiment are configured mainly to emphasize that the first LED bead 15 and the second LED bead 16 receive respective driving signals independently. Therefore, no strict limitation is made to specific forms of the first circuit and the second circuit, which may be a simple electrical conductor, or other circuit modules capable of transmitting the driving signals, and the like. A transmission mode may be a wireless transmission mode or realized by wires.

In order to adapt to independent control, two flexible strips 14 are provided. One flexible strip is electrically connected to the driving module by the first circuit, and the other flexible strip is electrically connected to the driving module by the second circuit.

The two repair holes 55 corresponding to the same lamp strip 10 are arranged spaced apart or continuously. When the two repair holes 55 corresponding to the same lamp strip 10 are arranged continuously, the two repair holes 55 and the avoiding holes 54 located between the two repair holes 55 are communicated.

With reference to one of the embodiments, when the two repair holes 55 corresponding to the same lamp strip 10 are arranged continuously, in order to minimize the length of the repair holes 55 (the length direction of the repair holes 55 is the same as the length direction of the lamp strip 10), the flexible strip 14 is located between two adjacent sets of beads, and at most one set of beads is arranged between two flexible strips 14. In this embodiment, one set of beads is arranged between two flexible strips 14.

Preferably, the length of the repair hole 55 ranges from 80 mm to 110 mm. In this embodiment, the length of the repair hole 55 is 90 mm.

In other embodiments, for a positional relationship between the first LED beads 15 and the second LED beads 16 on the same lamp strip 10, in the same lamp strip 10, a distance between two adjacent first LED beads 15 is equal to that between two adjacent second LED beads 16. For any first LED bead 15 and two adjacent second LED beads 16, a distance between the first LED bead 15 and one of the second LED beads 16 is smaller than that between the first LED bead and the other one of the second LED beads 16.

Specifically, in the same lamp strip 10, for any first LED bead 15 and two adjacent second LED beads 16, a distance between the first LED bead 15 and one of the second LED beads 16 is L3, a distance between the first LED bead 15 and the other one of the second LED beads 16 is L4, and the following condition is met: L3:L4=1:1.5 to 6. Preferably, L3:L4=1:2 to 4. In this embodiment, L3 is 5 mm, and L4 is 20 mm.

The substrate 11 may be a metal substrate, preferably an aluminum substrate, or a FR-4 glass fiber board may be selected as the substrate 11. In some embodiments, the substrate 11 may be fixed to a lower surface of the back plate 20 by a screw, and preferably adhered and fixed to the lower surface of the back plate 20 by a thermally conductive glue.

As shown in FIG. 7 to FIG. 11, in some embodiments, the substrate 11 includes a metal layer 11, an insulating layer 112 and a circuit layer 113. The LED beads 12 are soldered on the circuit layer 113. In general, pads 115 for soldering the LED beads 12 is provided on the circuit layer 113. In order to provide the protection for the circuit layer 113, the surface of the substrate 11 is coated with white solder resist ink to form a solder resist layer 144, while openings are formed at the pads 115 to expose the pads 115 for soldering the LED beads 12.

The lenses 13 on the lamp strips 10 are mainly used for diffusing light. The lenses 13 are adhered and fixed on the substrates 11 by epoxy glue or a UV glue. In order to facilitate the mounting of the lenses 13, a protruding leg 131 is disposed on a back surface of each lens 13, and a positioning hole corresponding to the protruding leg is provided in the corresponding substrate 11.

In some embodiments, the flexible strip 14 is pressed on all the lamp strips 10 and intersects with all the lamp strips 10 perpendicularly to facilitate the soldering of the lamp strip 10 with the flexible strip 14. The flexible strip 14 is of a ribbon-shaped structure and includes an insulating layer 142, a circuit layer 143 and a solder resist layer 144, wherein the insulating layer 142 is made of an insulating resin material, and the solder resist layer 144 is formed of white solder resist ink coated on the surface.

In order to realize the connection, a first opening 141 that is not coated with solder resist ink is provided in the edge of the flexible strip 14, and a second opening 14 that is not coated with solder resist ink is provided in a position, which is adjacent to the flexible strip 14, of the substrate 11. Soldering pads are disposed on the two openings and electrically connected by soldering.

From the perspective of the processing technology and the heat dissipation, the back plate 20 is formed by a metal sheet (for example, ST13) by stamping to form an arched cover structure, which includes a central region 221 and edge regions 22 arranged on the periphery of the central region 221.

With reference to one of the embodiments, in terms of the form of connecting the frame strip 41 with the respective edges of the diffusion plate 30 and the back plate 20, each frame strip 41 has a first mounting surface 42 and a second mounting surface 43 at different levels (the level here refers to a height along a vertical direction when the direct-type panel lamp 100 is in the mounted state). The edge of the diffusion plate 30 is overlapped on the lower first mounting surface 42, and an edge region 22 of the back plate 20 is overlapped on the higher second mounting surface 43 and fixed by fastening screws.

The edge region 22 of the back plate 20 form a protruding rib 24 by deforming of the back plate 20, which extends along a side direction of the back plate 20 to increase the strength of the edge region 22. In some embodiments, in order to reduce the processing difficulty of the protruding rib 24, the edge region 22 is bent by itself to form the protruding rib 24. A conventional processing method, such as mechanical stamping, may be adopted for deformation.

The protruding rib 24 presses against the edge of the diffusion plate 30 to make it abut against the first mounting surface 42. Because the back plate 20 has a certain resilience, when the protruding rib 24 presses against the diffusion plate 30, the protruding rib 24 will resiliently deform. As a result, the protruding rib 24 exerts a pressure on the diffusion plate 30, and the protruding rib 24 is corresponding to the first mounting surface 42 to clamp the edge of the diffusion plate 30, so as to prevent the edge of the diffusion plate 30 from bending, thereby preventing a center portion of the diffusion plate 30 (a geometric center of the diffusion plate 30 or a portion near the geometric center of the diffusion plate 30) from collapsing downwards.

In some embodiments, the frame strips 41 are made of metal (such as an aluminum alloy), and end portions of adjacent frame strips 41 are welded and fixed. Certainly, the frame strip 41 may be made of a polymer material by injection molding. Since the polymer material cannot be welded and connected, it is generally necessary to provide corner pieces connecting adjacent frame strips 41 at corners of the frame 40, or adjacent frame strips 41 are in lap joint. However. Such frame 40 has poor flatness compared with a frame formed by welding process.

Figure 6:
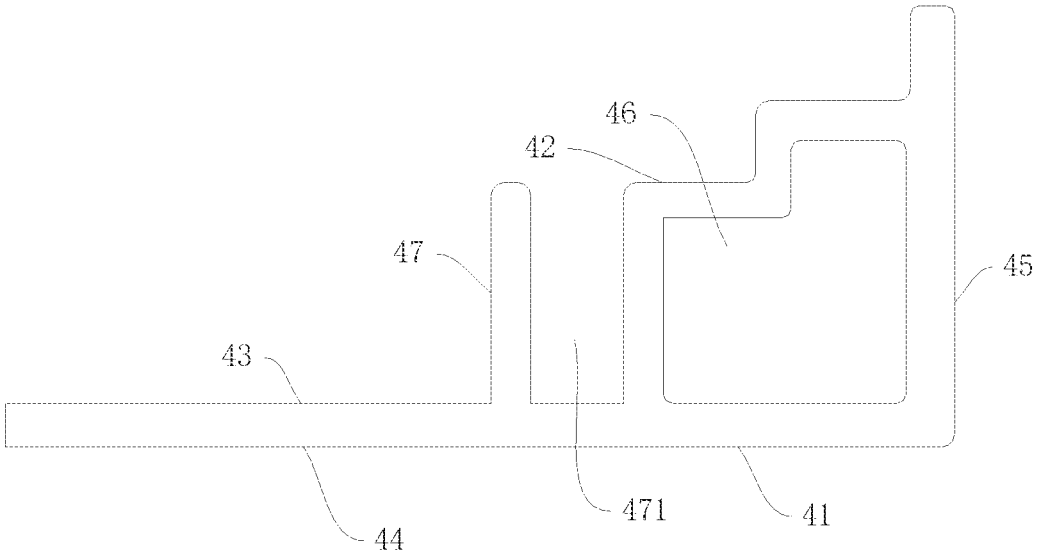
FIG. 6 is a schematic view showing a structure of a frame strip in FIG. 1.

In some embodiments, as shown in FIG. 5 and FIG. 6, each frame strip 41 has an L-shaped cross section, which includes a horizontal portion 44 and a vertical portion 45.

The edge of the diffusion plate 30 and the edge of the back plate 20 are both overlapped on the horizontal portion 44. The vertical portion 45 encloses a defined space for covering connections of the edge of the back plate 20, and plays roles of decoration and a certain protection.

In some embodiments, in order to increase the strength of the profile, the inner side of the corner of the frame strip 41 is thickened to form a thickening portion 46, thereby forming a step structure on the horizontal portion 44. The first mounting surface 42 and the second mounting surface 43 are respectively located on the step structure and the horizontal portion 44. In some embodiments, in order to save the material, the thickening portion is of a hollow structure.

From the perspective of the processing technology and the heat dissipation, the back plate 20 made of a metal plate (for example, ST13) by stamping to form an arched cover structure, so that there is a certain distance between the back plate 20 and the diffusion plate 30 to accommodate the lamp strips 10. In some embodiments, a bottom wall 231 of the back plate 20 is arranged in parallel with the diffusion plate 30. The lamp strips 10 are fixed on the bottom wall 231. The side walls 232 are tangentially connected with the first protruding ribs 24.

In some embodiments, a portion of the edge region 22 which is overlapped on the frame 40 is arranged in parallel with the bottom wall 231, and the bottom wall 231 is higher than the edge region 22. When the direct-type panel lamp 100 is mounted on the ceiling, the bottom wall 231 is arranged horizontally, and the edge region 22 which is overlapped on the frame 40 is arranged horizontally.

In some embodiments, as shown in FIG. 1 and FIG. 2, in order to facilitate the placement of the lamp strip 10, the bottom wall 231 is provided with grooves in which the lamp strips 10 are arranged in a crisscross pattern. In order to facilitate the machining of the groove in the back plate 20, the back plate 20 forms a plurality of protrusions 211 facing away from the chamber 23 by stamping. The grooves are formed between adjacent protrusions 211, and the lamp strips 10 are arranged in parallel. Therefore, the protrusions 211 should be arranged in parallel, and the gap between adjacent protrusions 211 is used to mount the lamp strip 10, so that the lamp strip 10 is generally of a strip-shaped structure. Certainly, the lamp strip may be of a spiral structure.

In some embodiments, the edge region 22 of the back plate 20 is fixed on the frame 40 by screws. In order to facilitate the mounting of the edge region 22, each frame strip 41 is provided with screw grooves 471 arranged along its length direction. In some embodiments, a vertical flange 47 is formed on the middle portion of the upper surface of the horizontal portion 44, the gap between the vertical flange 47 and the step structure serves as the screw groove 471, and the top surface of the vertical flange 47 supports the edge region 22.

In some embodiments, in order to reduce the weight of the back plate 20, the thickness of the back plate 20 ranges from 0.2 mm to 0.4 mm, provided that the supporting strength of the back plate 20 is satisfied. Preferably, the thickness of the back plate 20 is 0.3 mm.

Figure 12:
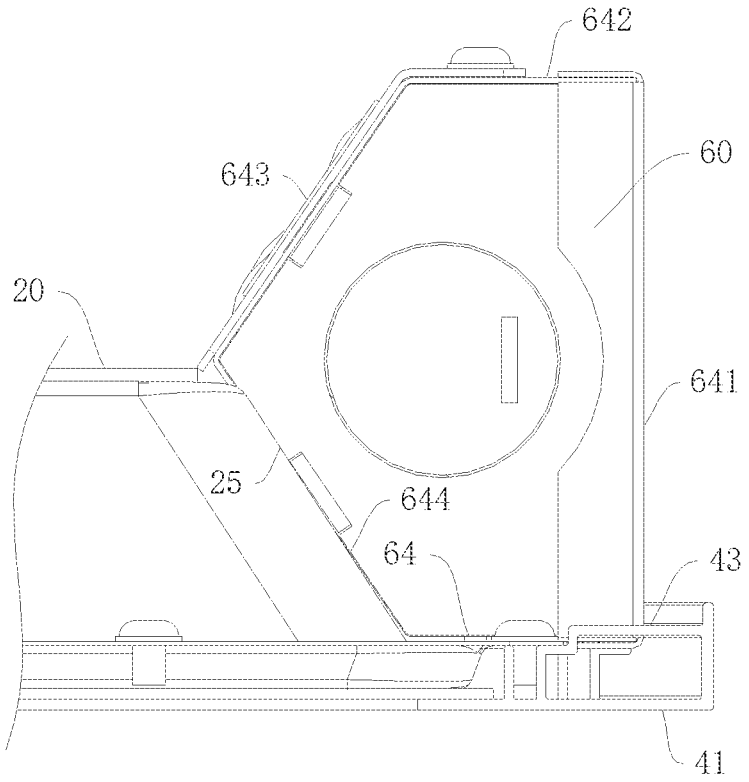
FIG. 12 is a partial schematic view showing a direct-type panel lamp in FIG. 1.
Figure 14:
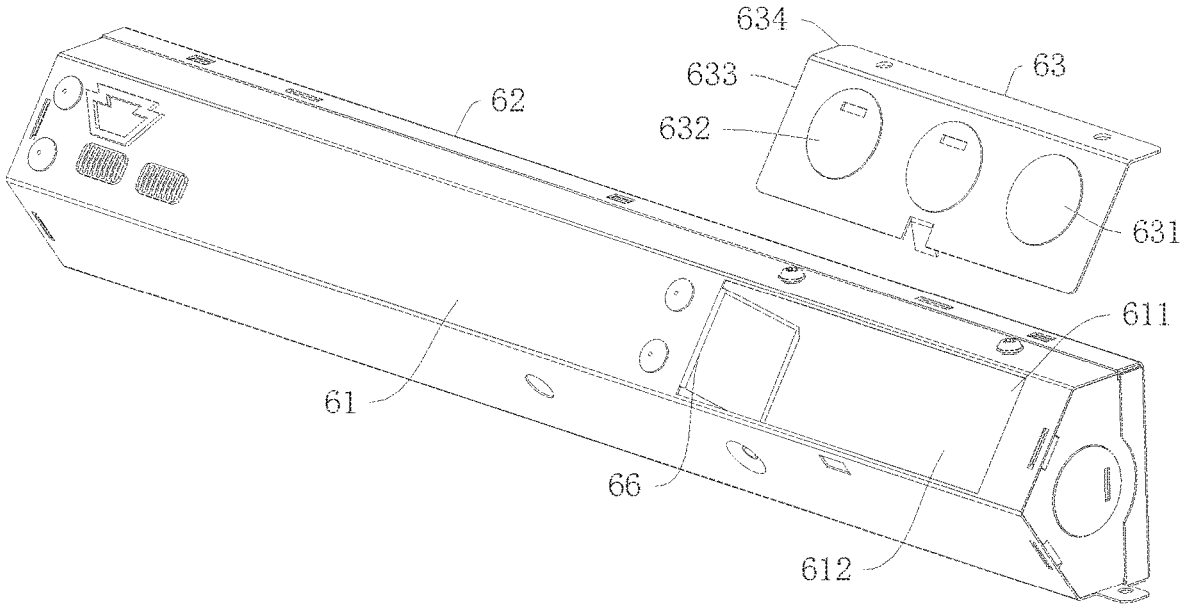
FIG. 14 is a schematic exploded view showing a structure of a driving box in FIG. 13.
Figure 15:
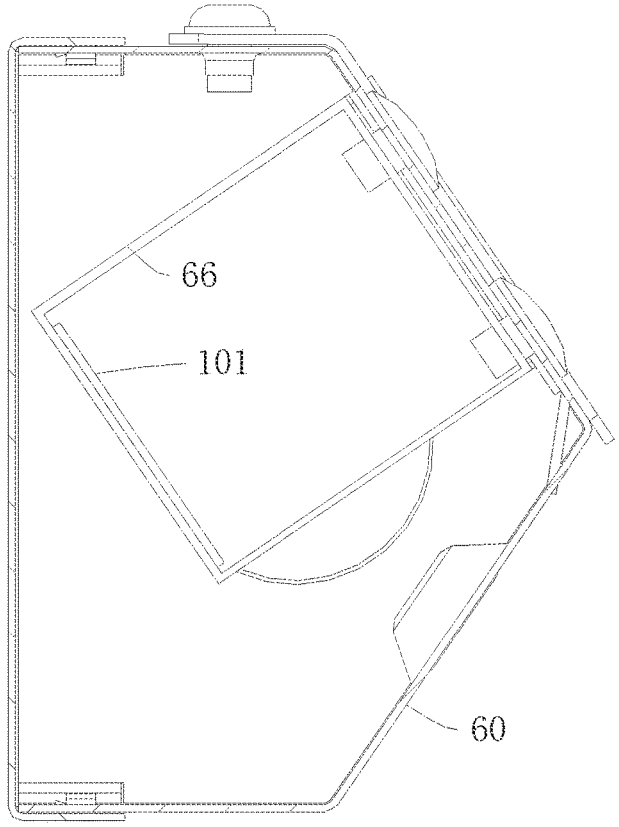
FIG. 15 is a schematic cross-sectional view showing a driving box in FIG. 13.

In one of the embodiments, as shown in FIG. 1, FIG. 2, and FIG. 14, in order to enable the direct-type panel lamp 100 work, a driving module 101 is mounted on the direct-type panel lamp 100, and the lamp strip 10 is electrically connected with the driving module 101 by conductive wires. In order to facilitate the fixation and the protection of the driving module 101, the driving module 101 is usually arranged within a driving box 60. As shown in FIG. 12 and FIG. 15, in one of the embodiments, the driving box 60 includes a box body 61 with an opening, and a top cover 62 fastened to the opening side of the box body 61. The box body 61 is provided with a through hole for wire 612 through which the connecting wires of the driving module 101 pass. The box body 61 is arranged in a strip shape, with a convex pentagonal cross section. The convex pentagon includes a first side 64, a second side 641, a third side 642, a fourth side 643 and a fifth side 644 which are arranged in sequence, wherein the first side 64 is arranged in parallel with the third side 642, the second side 641 is perpendicular to the first side 64 and the third side 642, a box wall corresponding to the first side 64 is attached to the second mounting surface 43, a box wall corresponding to the fifth side 644 is attached to the back plate 20, and a box wall corresponding to the second side 641 is provided in the form of the opening.

By mounting the driving module 101 within the driving box 60, the present application brings the convenience for fixing and protecting the driving module 101, and is capable of simplifying the step of maintaining or replacing the driving module 101, thereby lowering time and labor costs.

In one of the embodiments, in order to make the driving box 60 compact, as shown in FIG. 12, the side length of the first side 64 is equal to that of the third side 642, and the side length of the fourth side 643 is equal to that of the fifth side 642. In this embodiment, the length of the first side 64 and the length of the third side 642 are both 20 mm, the length of the second side 641 is 50 mm, and the length of the fourth side 643 and the length of the fifth side 644 are both 30 mm.

In one of the embodiments, as shown in FIG. 12, in order to quickly position the driving box 60, a slope region 25 is formed on an outer peripheral wall of the back plate 20, and a box wall corresponding to the fifth side 644 is corresponding to the slope region 25. Inclination angles of the slope region 25 and a box wall corresponding to the fifth side 644 are the same, and the slope region 25 and the box wall corresponding to the fifth side 644 conform each other. An inclination angle of the fifth side 644 changes with an inclination angle of the slope region 25, and the length of each side of the convex pentagon changes with the inclination angle of the fifth side 644.

In this embodiment, an included angle between the slope region 25 and the vertical axis ranges from 10 degrees to 20 degrees. Preferably, an included angle between the slope region 25 and the vertical axis is 16 degrees.

In order to facilitate the packaging two of the direct-type panel lamps 100, the back plates 20 of the two direct-type panel lamps 100 are placed face to face. Because the driving box 60 is located on the outer periphery of the back plate 20, and the top surface of the driving box 60 is higher than the back plate 20, a box wall corresponding to the fourth side 643 of each driving box 60 abuts against the slope region 25 of the other direct-type panel lamp 100. On the same direct-type panel lamp 100, the slope region 25 is higher than the back plate 20, so that when the two direct-type panel lamps 100 are packaged, the top surface of the driving box 60 will abut against the frame 40 of the other direct-type panel lamp 100. There will be a certain gap between the two back plates 20 to prevent the back plates 20 from deforming.

With reference to one of the embodiments, for a mounting position of the driving box 60, a mounting region (not shown in the figure) is formed between the vertical portion 45 and the outer periphery of the back plate 20, and the driving box 60 is disposed in the mounting region.

Figure 13:
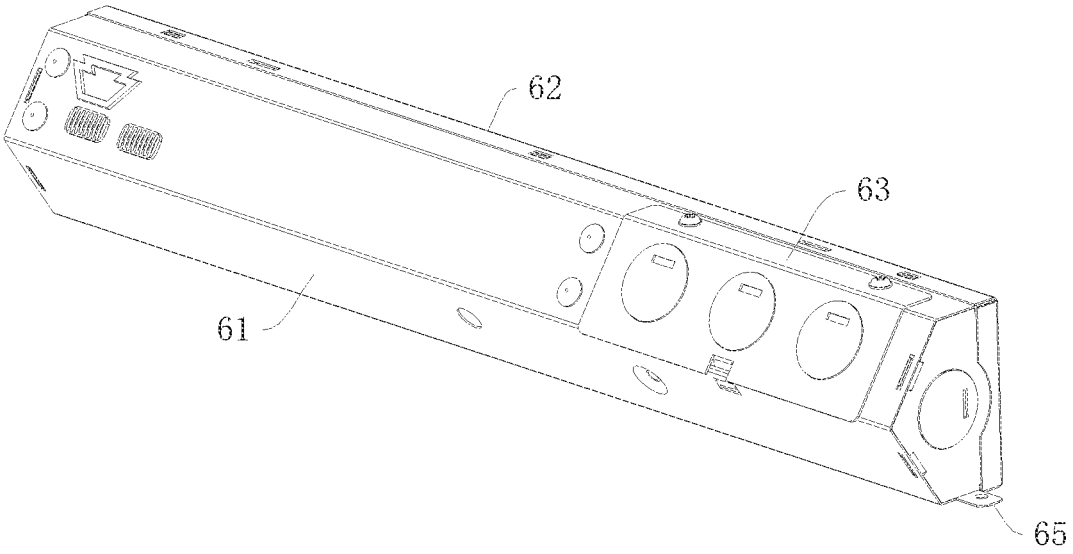
FIG. 13 is a schematic view showing a structure of a driving box in FIG. 12.

With reference to one of the embodiments, as shown in FIG. 13, for a mounting form of the driving box 60, lugs 65 with screw holes are disposed at two ends of the driving box 60, and the lugs 65 are fixed on the frame 40 (screw grooves 471) by fastening screws. The lugs 65 are connected to a box wall corresponding to the first side 64, and bottom surfaces of the lugs 65 are flush with a bottom surface of the box body 61. In order to reduce the difficulty of the processing technology of the lugs 65 and the box body 61 and to enhance the structural strength between the lugs 65 and the box body 61, the lugs 65 and the box body 61 are integrally formed.

With reference to one of the embodiments, as shown in FIG. 13 and FIG. 14, in order to make the wire through hole 612 avoid the back plate 20 and facilitate the operation of the connecting wires, the wire through hole 612 is provided in the box wall corresponding to the fourth side 643. The driving box 60 further includes a cover plate 63, which is mounted on the box body 61 and corresponding to the wire through hole 612. A plurality of unit holes 631 aligned with the wire through hole 612 are provided in the cover plate 63. The unit holes 631 may be determined according to the number of the connecting wires, and the connecting wires respectively pass out of the respective unit holes 631 to quickly distinguish the connecting wires.

The cover plate 63 is bent by itself to form a shielding portion 633 and a fixing portion 634. The fixing portion 634 is attached and fixed to the box wall corresponding to the third side 642. The shielding portion 633 is attached to the box wall corresponding to the fourth side 643. Each unit hole 631 is provided in the shielding portion 633.

With reference to one of the embodiments, as shown in FIG. 13 and FIG. 14, in order to avoid affecting the driving module 101 due to a foreign matter entering the driving box 60 when the driving box 60 is not in use, a plurality of unit covers 632 are disposed on the cover plate 63, and the plurality of unit covers 632 are respectively arranged in one-to-one correspondence with the unit holes 631. Further, the unit covers 632 are connected with inner edges of the unit holes 631 by deformable connectors (not shown in the figure), and the unit covers 632 may be opened by pushing the unit covers 632.

The driving box 60 is made of a sheet metal to strengthen the structural strength of the driving box 60. With reference to one of the embodiments, in order to reduce the influence of the driving box 60 on the driving module 101, the direct-type panel lamp 100 further includes an insulating box 66 mounted within the driving box 60, wherein the driving module 101 is mounted within the insulating box 66.

The insulating box 66 is of a strip shape, at least one end of the insulating box 66 is opened within the driving box 60, and the opening end is used for allowing the connecting wires of the driving module 101 to pass through. In this embodiment, both ends of the insulating box 66 are open end.

In some embodiments, the insulating box 66 has a rectangular cross section, which is closed in a circumferential direction. In two opposite side walls of the insulating box 66, one of the two opposite side walls of the insulating box 66 is attached and fixed to a side wall of the box body 61, and the other one of the two opposite side walls of the insulating box 66 is fixedly connected with the driving module 101. When the insulating box 66 is fixed on the side wall of the box body 61 by a bolt or riveting, the driving module 101 is capable of avoiding the bolt or a riveting part to reduce the influence of the bolt or the riveting part on the driving module 101.

With reference to one of the embodiments, for the mounting position of the insulating box 66, a length direction of the driving box 60 is consistent with a length direction of the insulating box 66. One end of the insulating box 66 is adjacent to one end portion of the driving box 60, and a wire through chamber 611 is formed between the other end of the insulating box 66 and the other end portion of the driving box 60. The wire through hole 612 is communicated with the wire through chamber 611. The wire through hole 612 and the insulating box 66 are located on the same side wall of the box body 61, and the wire through hole 612 and the insulating box 66 are arranged sequentially along a length direction of the driving box 60.

In some embodiments, in order to form a certain operating space in the wire through chamber 611, the length of the driving box 60 is D1, the length of the insulating box 66 is D2, and the following condition is met: D1:D2=1.5 to 3. Preferably, D1:D2=2.

In some embodiments, when the connecting wires of the driving module 101 enters the wire through hole 612 from one end, which is away from the wire through chamber 611, of the insulating box 66, in order to enable the connecting wire pass through the gap between the driving box 60 and the insulating box 66, the cross-sectional area of the driving box 60 is S1, the cross-sectional area of the insulating box 66 is S2, and the following condition is met: S1:S2=1.2 to 2. Preferably, S1:S2=1.5.

The technical features of the above embodiments may be combined arbitrarily. For brevity of description, all possible combinations of the technical features in the above embodiments are not described. However, the combinations of these technical features should be considered as the range described in this specification in any way if they are not contradictory. When the technical features of different embodiments are embodied in the same accompanying drawing, it should be considered that the accompanying drawing discloses combination examples of the various embodiments involved.

The above embodiments only present a few implementation modes of the present application, with a relatively specific and detailed description. However, they should not be understood as a limitation on the scope of the patent application. It should be noted that for those ordinarily skilled in the art, a number of modifications and improvements may be made without departing from the concept of the present application, and all the modifications and improvements fall within the protection scope of the present application.

What is claimed is:

1. A direct-type panel lamp with uniform light, comprising:

at least one lamp strip, each lamp strip comprising a substrate and a plurality of LED beads fixed on the substrate;

a back plate, with a central region bulging to form a chamber for accommodating the lamp strip, the chamber comprising a flat bottom wall and a plurality of inclined side walls, wherein each of the at least one lamp strip is fixed on the bottom wall;

a diffusion plate, having a light transmitting function, and arranged opposite to the back plate to close the chamber;

a frame, formed by connecting a plurality of frame strips, and each frame strip is connected with a respective edge of the diffusion plate and a respective edge of the back plate; and a reflective sheet, located in the chamber and attached to the back plate, wherein the reflective sheet is provided with a plurality of cut-outs, and two side edges of each cut-out are attached to each other to adapt to a corner of the back plate.

2. The direct-type panel lamp with uniform light according to claim 1, wherein the corners of the back plate are located at joining parts of the bottom wall and the side walls and/or at turning parts between the side walls.

3. The direct-type panel lamp with uniform light according to claim 1, wherein the reflective sheet comprises a central region and a plurality of folded edges extending along side directions of the central region respectively, each cut-out is provided in a corner between two folded edges, the central region of the reflective sheet is attached to the bottom wall, the folded edges are attached to the side walls respectively, and two opposite side edges of each cut-out are attached to form a box-shaped structure.

4. The direct-type panel lamp with uniform light according to claim 1, wherein each substrate is located between the reflective sheet and the back plate, and the reflective sheet is provided with an avoiding hole for avoiding the LED beads.

5. The direct-type panel lamp with uniform light according to claim 1, wherein when the reflective sheet is in an unfolded flat state, an included angle between two opposite side edges of each cut-out ranges from 20 degrees to 90 degrees.

6. The direct-type panel lamp with uniform light according to claim 3, wherein the central region is of a polygon shape, the number of the folded edges is corresponding to a number of sides of the polygon shape, and joining parts of two adjacent folded edges along the circumferential direction of the central region are defined as the corners of the folded edges.

7. The direct-type panel lamp with uniform light according to claim 6, wherein the diffusion plate is of a flat plate structure and is arranged parallel to the bottom wall.

8. The direct-type panel lamp with uniform light according to claim 5, wherein the central region is configured as a rectangular shape, the number of the folded edges is four, and each folded edge is arranged on a respective side of the central region; and wherein each cut-out is arranged between two adjacent folded edges, and each folded edge extends with constant width along a side direction of the central region.

9. The direct-type panel lamp with uniform light according to claim 8, wherein the central region covers the bottom wall, each folded edge covers a corresponding side wall, and two adjacent folded edges are arranged without overlapping each other.

10. The direct-type panel lamp with uniform light according to claim 3, wherein a plurality of pores are provided at folds between the central region and the folded edges, and the plurality of pores are arranged in sequence along extending directions of the folds.

11. The direct-type panel lamp with uniform light according to claim 10, wherein each pore is strip-shaped, and the plurality of pores are arranged along side directions of the central region.

12. The direct-type panel lamp with uniform light according to claim 11, wherein the pores are configured in the form of hollows or slits.

13. The direct-type panel lamp with uniform light according to claim 2, wherein the central region of the reflective sheet is provided with a plurality of repair holes; and wherein the at least one lamp strip comprises a plurality of lamp strips, and adjacent lamp strips are electrically connected by at least one flexible strip, and connecting parts of the lamp strips and the flexible strip are respectively corresponding to the repair holes.

14. The direct-type panel lamp with uniform light according to claim 13, wherein the plurality of lamp strips extend longitudinally and are spaced apart from each other, the LED beads on the lamp strips are aligned, the at least one flexible strip is arranged and extending horizontally; and the repair holes are aligned with each other.

15. The direct-type panel lamp with uniform light according to claim 14, wherein as for each repair hole, along a length direction of the corresponding lamp strip, a distance between two opposite edges of the repair hole is greater than the width of the corresponding flexible strip; and along a length direction of the corresponding flexible strip, a distance between two opposite edges of the repair hole is greater than the width of the corresponding lamp strip.

16. The direct-type panel lamp with uniform light according to claim 13, wherein in a same lamp strip, the plurality of LED beads comprise a plurality of first LED beads and a plurality of second LED beads, wherein the first LED beads and the second LED beads are alternately arranged, and the first LED beads and the second LED beads are different in brightness or color temperature.

17. The direct-type panel lamp with uniform light according to claim 16, wherein in a same lamp strip, one of the first LED beads and one of the second LED beads which are adjacent form a set of beads, and a distance between the first LED bead and the second LED bead in a same set of beads is L1, a distance between two adjacent sets of beads is L2, and the following condition is met: L1:L2=1:2 to 8.

18. The direct-type panel lamp with uniform light according to claim 17, wherein the repair holes are provided adjacent to one side of the reflective sheet, and at most one set of beads is arranged between each repair hole and the side of the reflective sheet to which the repair hole is adjacent.

19. The direct-type panel lamp with uniform light according to claim 18, wherein all the first LED beads are electrically connected by a first circuit, and all the second LED beads are electrically connected by a second circuit;

wherein the at least one flexible strip comprises two flexible strips and the two flexible strips are respectively electrically connected with the first circuit and the second circuit; and wherein two repair holes corresponding to a same lamp strip are arranged spaced apart or continuously.

20. The direct-type panel lamp with uniform light according to claim 19, wherein each flexible strip is located between two adjacent sets of beads, and at most one set of beads is arranged between the two flexible strips.

* * * * *